US006247482B1

(12) United States Patent
Muis

(10) Patent No.: US 6,247,482 B1
(45) Date of Patent: Jun. 19, 2001

(54) LIGHTWEIGHT HANDS-FREE ALTERNATIVE UMBRELLA AND CARRYING CASE

(76) Inventor: Robert Chris Muis, 2442 S. Ridge Ave., Bullhead City, AZ (US) 86429

( * ) Notice: Subject to any disclaimer, the term of this patent is extended or adjusted under 35 U.S.C. 154(b) by 0 days.

(21) Appl. No.: 09/192,478

(22) Filed: Nov. 16, 1998

(51) Int. Cl.[7] ..... A45B 3/00
(52) U.S. Cl. ..... 135/16; 224/188; 224/190
(58) Field of Search ..... 135/15.1, 16, 20.1, 135/27, 33.2, 34.2, 87; 227/181, 185, 186, 188, 190

(56) References Cited

U.S. PATENT DOCUMENTS

| | | | | |
|---|---|---|---|---|
| D. 330,455 | | 10/1992 | Massie . | |
| 5,201,332 | * | 4/1993 | Wu | 135/16 |
| 5,263,837 | | 11/1993 | Dompe . | |
| 5,318,055 | | 6/1994 | Olaniyan . | |
| 5,409,391 | | 4/1995 | Lamb . | |
| 5,513,786 | | 5/1996 | Drane . | |
| 5,848,741 | * | 12/1998 | Fair | 224/186 |
| 5,896,590 | * | 4/1999 | Fleisch | 224/186 |
| 6,024,264 | * | 2/2000 | Java | 135/16 |

* cited by examiner

*Primary Examiner*—Beth A. Stephan

(57) ABSTRACT

A device consisting in it's entirely of a polyethylene, polyolefin, or the like blend of lightweight materials, having a canopy/convex-shaped hood affixed to a sturdy, hinged backboard with in adjustable lumbar support plus two shoulder supports with attached easy-apply harness and waist belt, to be worn by the user in place of holding a conventional umbrella in one's hand. This alternative hands-free umbrella device is comfortably harnessed to the user's torso, thus sheltering his/her head, shoulders, backside, and arms from most weather conditions such as rain, sleet, snow, and sun. While not in use, this device serves as a carrying case when folded in the closed orientation or can be utilized as an emergency floatation device thereupon in the same position. For an additional convenience there is a personal pouch attached to the lower backside of the invention for storage of smaller items while being worn by the user.

20 Claims, 4 Drawing Sheets

LIGHTWEIGHT HANDS-FREE ALTERNATIVE UMBRELLA AND CARRYING CASE

FIELD OF THE INVENTION

This invention relates to a device to be worn by the user to protect him/her from weather conditions such as rain, sleet, snow, and sun, at which to free both hands while being worn and when not used as such, this invention also serves as a carrying case or emergency floatation device.

BACKGROUND OF THE INVENTION

As well known, an umbrella is a canopy or shade screen which opens, folds, and is carried in the hand as a shelter from various weather conditions and is usually made from water repellent cloth on folding radial bars or strips fastened to an axial rod. While an umbrella is in use, it must be held with at least one hand making some tasks such as shopping or holding an infant or other articles rather difficult, especially if one is handicapped.

A number of patents disclose umbrella holders which secure opened umbrellas onto the body in order to free both hands of the user. The umbrella holder disclosed in the prior art range from simple harnesses to complex mechanical devices, which may have several drawbacks.

U.S. Pat. No. 5,263,837 discloses an umbrella holder in which a plate is harnessed onto the individual's torso with leather or of the like straps and has an adjustable mechanical pole in which an umbrella is to be inserted. The umbrella is relatively uncomfortable for the user with all the weight baring upon the harness straps because the back plate is too small in size and also allows only straight handled umbrellas to be inserted into this device.

U.S. Pat. No. 5,318,055 discloses a shoulder supported umbrella apparatus in which there is a relatively heavy piece of hardware strapped onto both of the individual's shoulders in separate form at which point the apparatus is cranked and two shields or half-plates are lifted into place to become a flat umbrella. It is therefore noted that this prior art brings a heavy burden on one's shoulders as well as there is a very limited amount of protection due it's smaller flat circular size. U.S. Pat. No. 5,409,291 discloses a combined chair and backpack umbrella holder whereas once again an umbrella must be separately attached thereto. This invention shows to be a much more comfortable art, but bears no other relation to my invention other than it provides a pouch or holding compartment(s) for the user. U.S. Pat. No. 5,513,786 discloses an umbrella holder in which an over-the-shoulder type harness is provided with fasteners to hold the umbrella on one's left front side. This immediately brings to attention an umcomfortability for a female wearing this umbrella holder along with the umbrella axial rod becoming an obstacle on the front side of one's face.

U.S. Pat. No. Des. 330,455 discloses a vest-like umbrella holder which in all means looks to be more comfortable than the others, but once again an umbrella must be separately attached to the back-side of the wearer still bearing no resemblance to my invention.

While it can be thus appreciated that the field of umbrella holders and the like were designed to keep one's hands free, they all must be incorporated with a separately supplied conventional umbrella.

SUMMARY OF THE INVENTION

Accordingly, it is an object the present invention provide a hands-free alternative light-weight umbrella for numerous weather conditions which can be easily and quickly applied to oneself without encumbering complications.

It is further object to provide while not being worn by the individual, a carrying case to hold several items such as a purse, lunch, paperwork, clothing, etc.

It is another object to provide an emergency floatation device due to the material this invention is derived from. This enables the individual to hold onto the unit if necessary during a flood or other means of water related emergencies.

An even further object is to provide a personal pouch on the backside of the unit for storing small items while being worn, or in the case of sun and heat protection, a water misting unit to cool the individual.

The above and other objects and advantages of this invention are pointed out with particularity in the claims annexed hereto and forming a part hereof. However, for a better understanding of the invention, the advantages, and the objects obtained by its use, the following drawings which form a further part hereof, should be referenced in which there is illustrated and described preferred embodiments of the invention.

DETAILED DESCRIPTION OF THE PREFERRED EMBODIMENT

Figure 1:
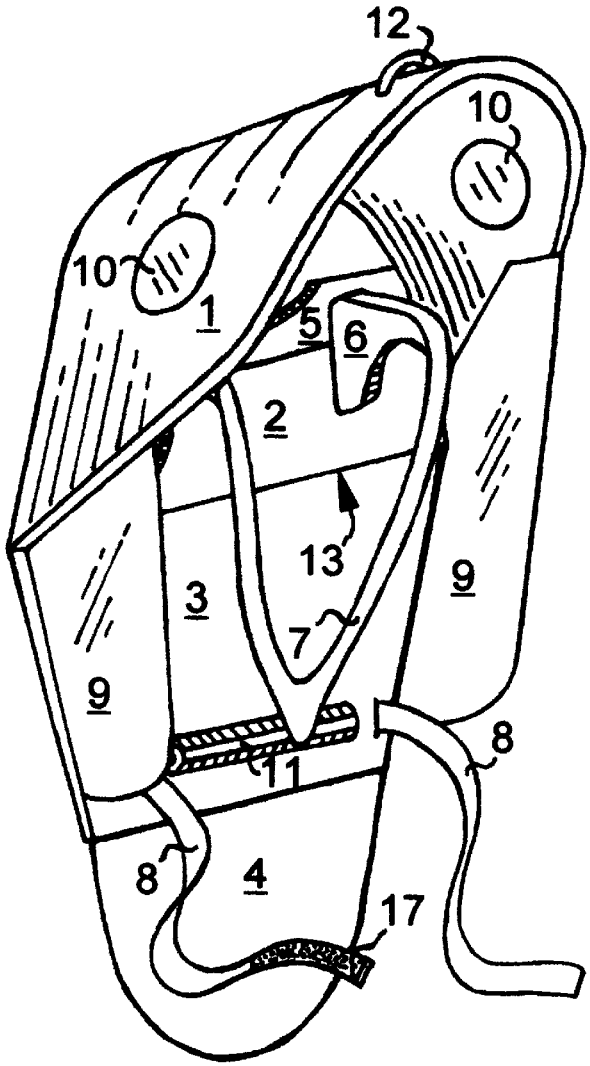
FIG. 1 is a perspective view of the preferred embodiment of the present invention depicting the device folded to an open position ready for use.
Figure 2:
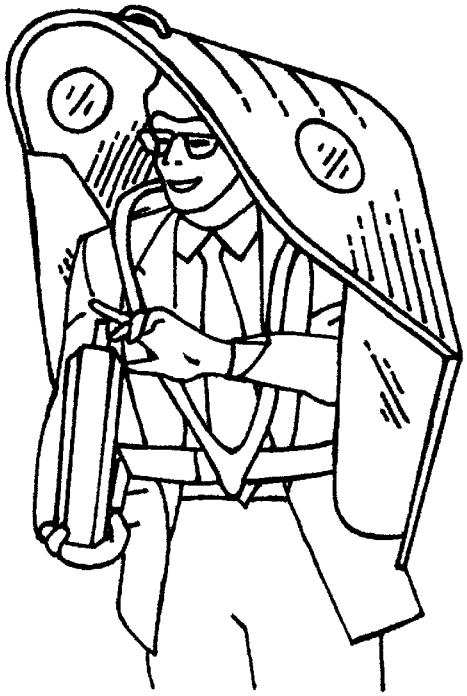
FIG. 2 is a perspective view of the preferred embodiment of the present invention being worn by the user.

Referring now to the drawings, in particular to FIGS. 1 though 8, an alternative hands-free umbrella device consisting in it's entirety of a polyethylene, polyolefin, or the like blend of lightweight material comprising the following detailed preferred embodiment:

A canopy/convex shaped hood I consisting of approximately ½" semi-flexible material thereof laminated by heat or adhesives along the outer edge of the upper backboard 2 bearing side port windows 10 depending upon the weather usage of the device which may be complete circle cut-outs as shown or a combination of small vents cut in various appropriate locations within the scope of the invention.

The upper backboard 2 and lower backboard 3 are comprised of a denser non-flexible material thereof approximately ½" to ¾" thickness having a softer flexible skin of approximately ⅛" laminated on one side connecting the two pieces and also serving as a hinge 13 in order that the device may be folded into the closed position.

Figure 6:
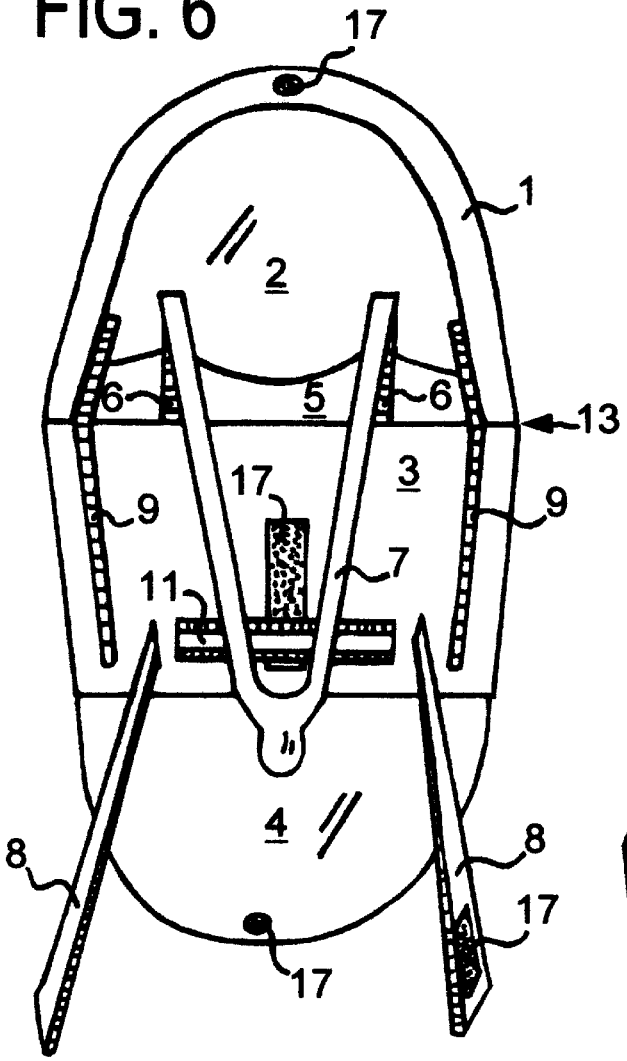
FIG. 6 is a front view thereof, with the invention folded to an open position ready for use.

An adjustable lumbar support 11 is affixed to the lower backboard 3 with VELCRO stripping 17 as illustrated in FIG. 6 in order to accommodate various sized individuals for a more comfortable fit comprised of the same material thereof.

A shoulder support brace 5 with appropriate slots cut out to accommodate the shoulder supports 6 for added strength and correct placement of shoulder supports 6, is adhered in the likeness to the inside of the upper backboard 2. The shoulder support brace 5 and shoulder supports 6 are comprised of a denser non-flexible material thereof approximately ½" to ¾" thickness.

The harness 7 is adhered in the likeness to the top of the shoulder supports as illustrated in FIG. 1 and is comprised of approximately ⅛" thin flexible material thereof having a VELCRO tab 17 on the inside of the harness bottom for easy-apply and adjustment to accommodate various sized individuals.

Figure 7:
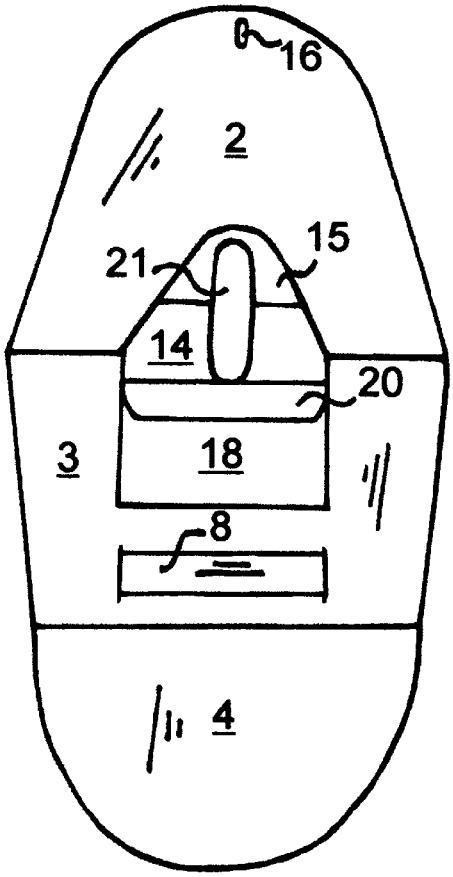
FIG. 7 is a back view thereof, with the invention folded to an open position ready for use.
Figure 8:
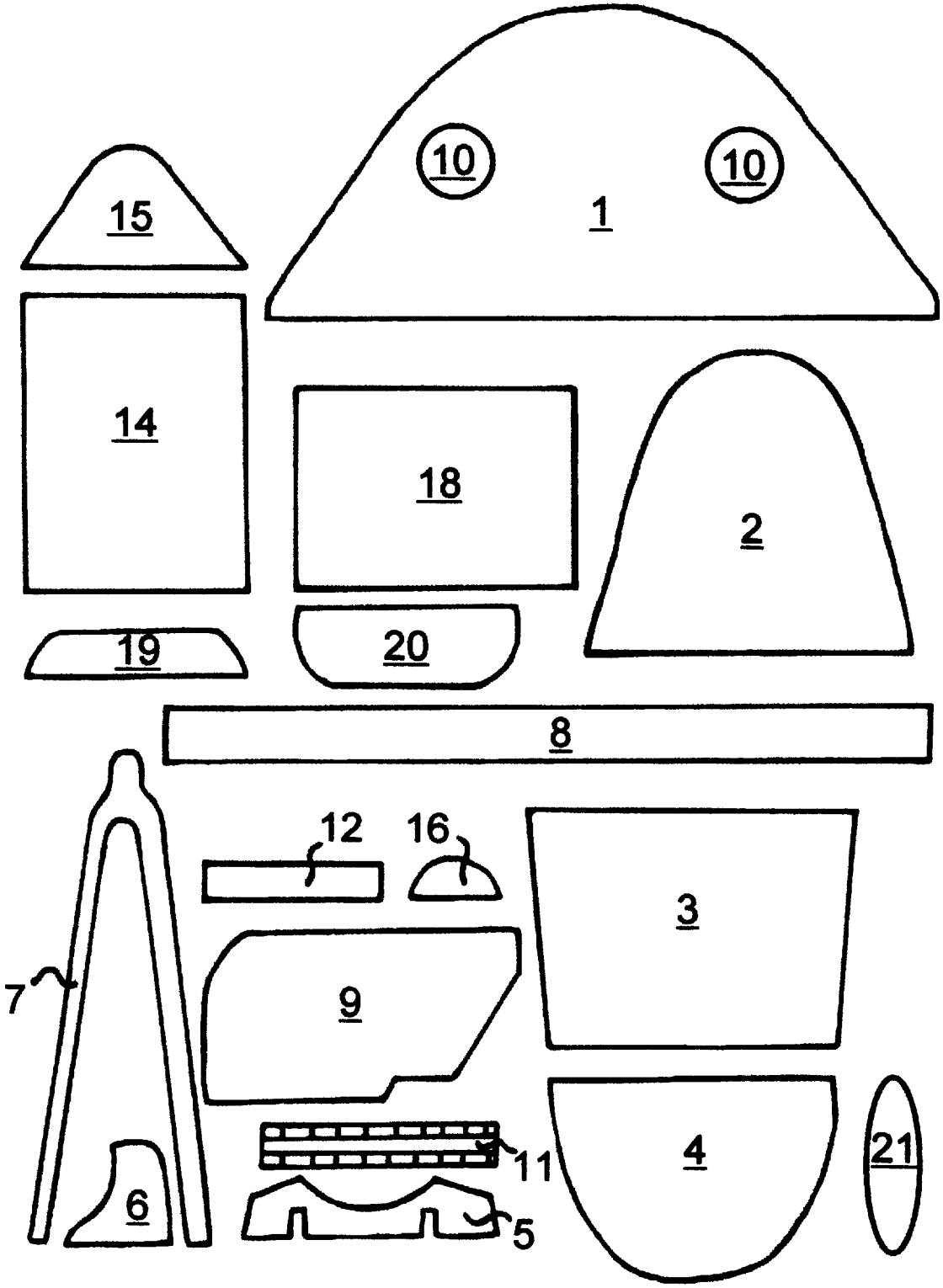
FIG. 8 shows all pieces of the preferred embodiment in a flat formation.

The waist belt 8 is comprised of approximately ⅛" thin flexible material thereof and is threaded through two incisions on the back of the lower backboard 3 as shown in FIG. 7 whereas it is adhered in the likeness to the backside of the lower backboard 3 and extends outward toward the front of the device in order to fit around the individual's waist having adjustable VELCRO tabs 17 to accommodate various sized users along with a VELCRO placement tab 17 for the harness 7 to be adhered once again for easy-apply.

Figure 4:
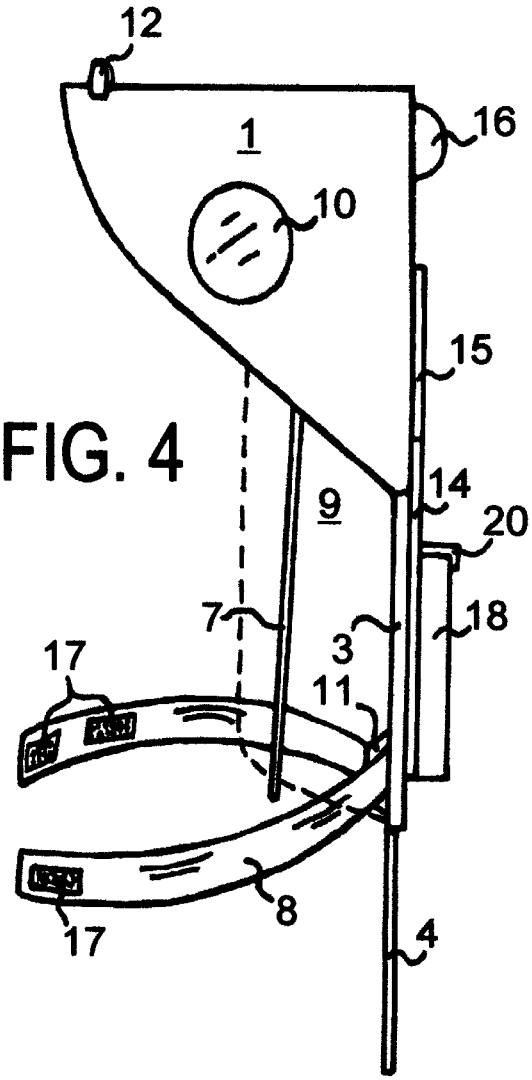
FIG. 4 is a side view thereof, with the invention folded to a closed position.

A lower body protection flap 4 is adhered in the likeness to the inside edge of the lower backboard 3 which also serves as a lid shown in FIG. 4 when the device is in the closed position. The protection flap/lid 4 is adhered to the hood I with a VELCRO tab(s) 17 while in the closed position.

Figure 3:
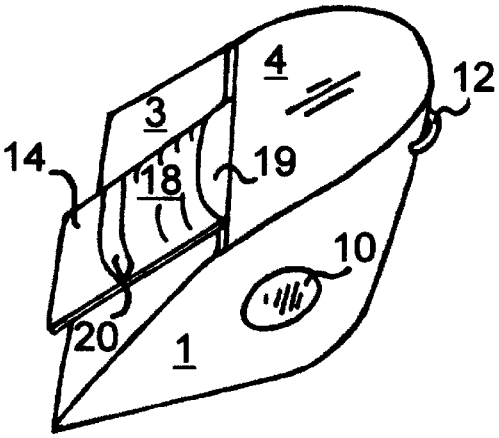
FIG. 3 is a partial side and top view thereof, with the invention folded to a closed position.
Figure 5:
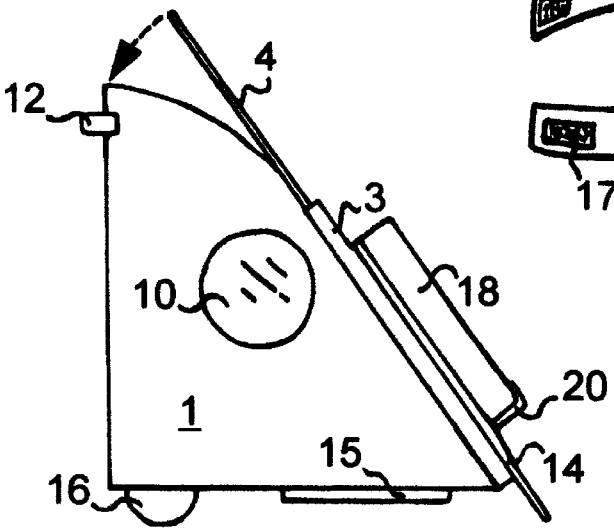
FIG. 5 is a side view thereof, with the invention folded to an open position ready for use.

The arm covers 9 shown in FIG. 1 as being a part thereof, and shown in FIG. 5 as a translucent outline, are comprised of approximately ⅛" thin flexible material of the like and are adhered in the likeness to the sides of the hood 1, upper backboard 2, and lower backboard 3, and may be omitted as in FIG. 5 depending upon the usage of the device in various weather conditions. These arm covers 9 collapse into the device when it is folded to the closed position as shown in FIG. 3.

In order to secure the invention in the open position, a stop plate 14 is adhered in the likeness to the backside of the lower backboard 3 in which it is butted against the latch plate 15 and is then secured by a VELCRO latch 21 as shown in FIG. 7 in order to prevent accidental forward collapse of the upper backboard 2. The stop plate 14 and the latch plate 15 is comprised of a denser non-flexible material thereof approximately ½" to ¾" thickness. The stop plate 14 also serves as a stand while the device is folded in the closed position as shown in FIG. 4.

A foot 16 is adhered in the likeness to the backside of the upper backboard 2 comprised of the non-flexible material thereof approximately ½" to ¾" thickness and supports the device while in the closed position as shown in FIG. 4.

A handle 12 is threaded through and/or adhered in the likeness to the upper outside of the hood 1 comprised of approximately ⅛ thin flexible material of the like converting the device into a handy carrying case while not being worn by the user in the closed position whereas making it possible to store a number of articles.

The personal pouch 18, personal pouch bottom 19, and personal pouch lid 20, are comprised of ⅛" thin flexible material of the like. The personal pouch 18 itself is adhered in the likeness to the stop plate 14 by its edges only forming a pocket of approximately 2" thick as in the thickness of the personal pouch bottom 19. The personal pouch lid 20 becomes and is a part thereof the latch 21 as shown in FIG. 7. The personal pouch 18 is to be used for either storage of smaller items while being worn by the user or to house a water misting unit to cool the individual while being worn in warmer temperatures whenever appropriate.

However, it is to be understood, that even though numerous advantages and characteristics of the present invention have been set forth in the foregoing description, together with the function and details of the invention, the disclosure is illustrative only, and changes may be made in detail pertaining to size, shape, materials, parts, and arrangement of parts falling within the scope of the invention.

Having thus described my invention, I claim:

1. An alternative hands-free umbrella and carrying case device comprising:

a) A canopy/convex-shaped hood, fabricated of a sturdy light-weight material, such as polyethylene, affixed to a hinged backboard comprising an upper and lower section, fabricated of said material, for sheltering a user's head, shoulders, and backside;

b) further comprising an adjustable lumbar support, fabricated of a sturdy light-weight material, such as polyethylene, for added comfort while the device is being worn;

c) further comprising two shoulder supports, fabricated of a sturdy lightweight material, such as polyethylene, affixed to a shoulder brace, fabricated of said material, for quick wear and easy application, therefore, allowing the device to stay in place while being worn;

d) further comprising a waist belt, fabricated of flexible material, threaded through said hinged lower backboard section comprising hook and loop fastening means to fit various sized individuals;

e) further comprising a "V" shaped one-piece harness, fabricated of flexible material, affixed to said shoulder supports comprising hook and loop fastening means to fit various sized individuals;

f) further comprising arm covers, fabricated of flexible material, affixed to the left and right side of said hood, and to the left and right side of said hinged upper backboard;

g) further comprising side port windows, fabricated of clear thin plastic material, located on the left and right side of said hood for viewing safety;

h) further comprising a hinge, fabricated of flexible material, affixed to said upper and lower backboard section allowing the device to fold into a closed orientation;

i) further comprising a lower body protection flap, fabricated of flexible material, which serves as a lid for the device when the device is folded into a closed orientation while not being worn;

j) further comprising a handle, fabricated of flexible material, affixed to said hood so that the device can be easily carried while not being worn;

k) further comprising a stop plate, fabricated of a sturdy light-weight material, such as polyethylene, to prevent the device from folding into a closed orientation while being worn, secured with a latch plate and hook and loop surfaced latch, fabricated of flexible material, whereas, this stop plate may also serve as a stand while the device is in a closed orientation and not being worn;

l) further comprising a personal pouch and lid, comprising hook and loop fastening means fabricated of a flexible material, which is affixed to said stop plate and said hinged lower backboard section for storage of personal items.

2. An alternative hands-free umbrella and carrying case device as in claim 1; wherein said hood is flat on top and sides, being of a square shape.

3. An alternative hands-free umbrella and carrying case device as in claim 1; wherein said harness, belt, and handle, is fabricated of strapping.

4. An alternative hands-free umbrella and carrying case device as in claim 1; wherein said harness, belt, handle, arm covers, lower body protection flap, and personal pouch and lid, is fabricated of water repellant fabric.

5. An alternative hands-free umbrella and carrying case device as in claim 1; wherein said harness, belt, handle, arm covers, lower body protection flap, and personal pouch and lid, is fabricated of thin plastic material.

6. An alternative hands-free umbrella and carrying case device as in claim 1; wherein said harness, belt, arm covers, and personal pouch lid, comprise buckles as adjustable closures.

7. An alternative hands-free umbrella and carrying case device as in claim 1; wherein said arm covers are extended to the front of a user's torso comprising hook and loop fastening means in various locations beginning at shoulder height, in equally spaced proportion, being of the likeness of a cape, to protect a user's torso from various weather conditions.

8. An alternative hands-free umbrella and carrying case device as in claim 1; wherein said arm covers comprise strap and buckle means of fastening in front of a user's torso at shoulder height.

9. An alternative hands-free umbrella and carrying case device as in claim 1; wherein said harness, belt, and personal pouch lid, comprise snap buttons as adjustable closures.

10. An alternative hands-free umbrella and carrying case device as in claim 1; wherein said hood, upper and lower backboard sections, shoulder supports, personal pouch, lumbar support, and lower body protection flap, are molded as one solid structure, fabricated of a rigid light-weight material.

11. An alternative hands-free umbrella and carrying case device as in claim 8; wherein said lower body protection flap is not a part of said molded one-piece structure, therefore, being fabricated of a flexible material and affixed to said molded one-piece structure.

12. An alternative hands-free umbrella and carrying case device as in claim 1; wherein said harness consists of two adjustable straps in a configuration of a backpack or parachute harness, affixed to said shoulder supports and said hinged lower backboard section, therefore, to be worn around a user's shoulders and underarms.

13. An alternative hands-free umbrella and carrying case device comprising:

a) A lower backboard, fabricated of aluminum tubular framing, formed into a "U" shape;

b) further comprising an upper backboard, fabricated of aluminum tubular framing, formed into a "U" shape being of a smaller outside diameter than said lower backboard tubular framing, whereas, said upper backboard is capable of sliding into said lower backboard, therefore, placing the device into a closed orientation;

c) further comprising a hood, fabricated of aluminum tubular framing, formed into a "U" shape comprising a channel at each end which joins said hood framing with said upper backboard framing, affixed in such a manner that when lifted into an open orientation, locks into place by means of tension between said hood framing, furthermore, in order to unlock said hood, one need only push said hood framing together slightly to release and fold said hood down into a closed orientation;

d) further comprising a hood brace, fabricated of a metal rod, placed between said hood framing to ensure the proper tension in which to "spring-lock" said hood into an open orientation;

e) further comprising a "U" shaped shoulder support unit, fabricated of aluminum tubing, whereas a support bar fabricated of a metal rod, slides into said shoulder support unit and then is inserted into said lower backboard framing, allowing said shoulder support unit to move up into place or down freely;

f) further comprising spring lock buttons, located at each end of said upper backboard framing, that slide into said lower backboard framing, therefore, locking said upper and lower backboard framing into place when the device is pulled into an open orientation;

g) further comprising a harness, fabricated of strapping, consisting of two pieces, affixed to said shoulder support unit, by means of clips or rings, threaded through another set of rings located on each side of said lower backboard framing, whereas, said strapping comprises an adjustable plastic slide release buckle, connecting in front or on either side of a user's torso at waistline height;

h) further comprising a water repellant fabric, covering said framing of hood, upper backboard and lower backboard, extending there between to form said hood, upper backboard and lower backboard i) further comprising protective side covers, fabricated of water repellant fabric, affixed to each side of said hood and upper backboard fabric covering;

j) further comprising a lower body protection flap, fabricated of water repellant fabric, affixed to said lower backboard fabric covering;

k) further comprising a personal pouch and lid, comprising hook and loop fastening means, fabricated of water repellant fabric, affixed to said lower backboard fabric;

l) further comprising a cape, fabricated of water repellant fabric, comprising hook and loop fastening means, affixed to the top of said personal pouch and lid, covering a user's entire torso while being worn;

m) further comprising a handle, fabricated of strapping, affixed to and between said personal pouch lid and lower backboard fabric;

n) further comprising an elastic cord, threaded through said lower backboard framing, affixed onto each end of said upper backboard framing, whereas, when said spring lock buttons are released, said upper backboard framing slides into said lower backboard framing.

14. An alternative hands-free umbrella and carrying case device as in claim 13; wherein said hood, hood brace, lower backboard framing, upper backboard framing, shoulder support unit, and shoulder support bar, are fabricated of plastic PVC tubing.

15. An alternative hands-free umbrella and carrying case device as in claim 13; wherein said hood, hood brace, lower backboard framing, upper backboard framing, shoulder support unit, and shoulder support bar, are fabricated of fiberglass tubing.

16. An alternative hands-free umbrella and carrying case device as in claim 13; wherein said harness and handle is fabricated of water repellant fabric.

17. An alternative hands-free umbrella and carrying case device as in claim 13; wherein said harness and handles fabricated of a thin plastic material.

18. An alternative hands-free umbrella and carrying case device as in claim 13; wherein said water repellant fabric covering, personal pouch and lid, lower body protection flap, protective side covers, and cape, are fabricated of a thin plastic material.

19. An alternative hands-free umbrella and carrying case device as in claim 13; wherein said harness comprises hook and loop fastening means.

20. An alternative hands-free umbrella and carrying case device as in claim 13; wherein said personal pouch and lid comprise a strap and buckle fastening means.

* * * * *